US005642121A

United States Patent [19]

Martek et al.

[11] Patent Number: 5,642,121

[45] Date of Patent: Jun. 24, 1997

[54] HIGH-GAIN, WAVEGUIDE-FED ANTENNA HAVING CONTROLLABLE HIGHER ORDER MODE PHASING

[75] Inventors: Gary A. Martek, Kent; Fred E. Ashbaugh, Seattle, both of Wash.

[73] Assignee: Innova Corporation, Seattle, Wash.

[21] Appl. No.: 33,628

[22] Filed: Mar. 16, 1993

[51] Int. Cl.[6] ..... H01Q 13/02

[52] U.S. Cl. ..... 343/786; 343/783; 343/785

[58] Field of Search ..... 343/785, 786, 343/783; 333/21 R; H01Q 13/00, 13/02, 13/06

[56] References Cited

U.S. PATENT DOCUMENTS

| | | | |
|---|---|---|---|
| 3,324,423 | 6/1967 | Webb | 333/21 R |
| 4,468,672 | 8/1984 | Dragone | 343/785 |
| 4,673,947 | 6/1987 | Newham | 343/785 |
| 4,783,665 | 11/1988 | Lier et al. | 343/785 |
| 5,109,232 | 4/1992 | Monte | 343/785 |

FOREIGN PATENT DOCUMENTS

| | | |
|---|---|---|
| 1904130 | 1/1969 | Germany . |
| WO87/06066 | 10/1987 | WIPO . |

OTHER PUBLICATIONS

Johnson et al, Antenna Engineering Handbook, 3rd ed, 1993, pp. 42—42 to 42–45.

*Primary Examiner*—Michael C. Wimer

*Attorney, Agent, or Firm*—Seed and Berry LLP

[57] ABSTRACT

A diverging shall antenna fed by a waveguide supplying $TE_{11}$ mode is described. A dielectric rod partially contained within the waveguide converts the $TE_{11}$ mode to a dominant or $HE_{11}$ mode. The $HE_{11}$ mode is controllably converted to second and third order modes in the diverging shell by discontinuities placed in predetermined locations in the diverging shell. The discontinuities generating the second mode are incorporated into the dielectric rod structure. Turning of the relative amplitude and phase of the second and third order modes relative to the $HE_{11}$ mode is achieved by slideably positioning the dielectric rod. An alternative embodiment of the inventive device includes a reactive surface of the diverging shell.

6 Claims, 5 Drawing Sheets

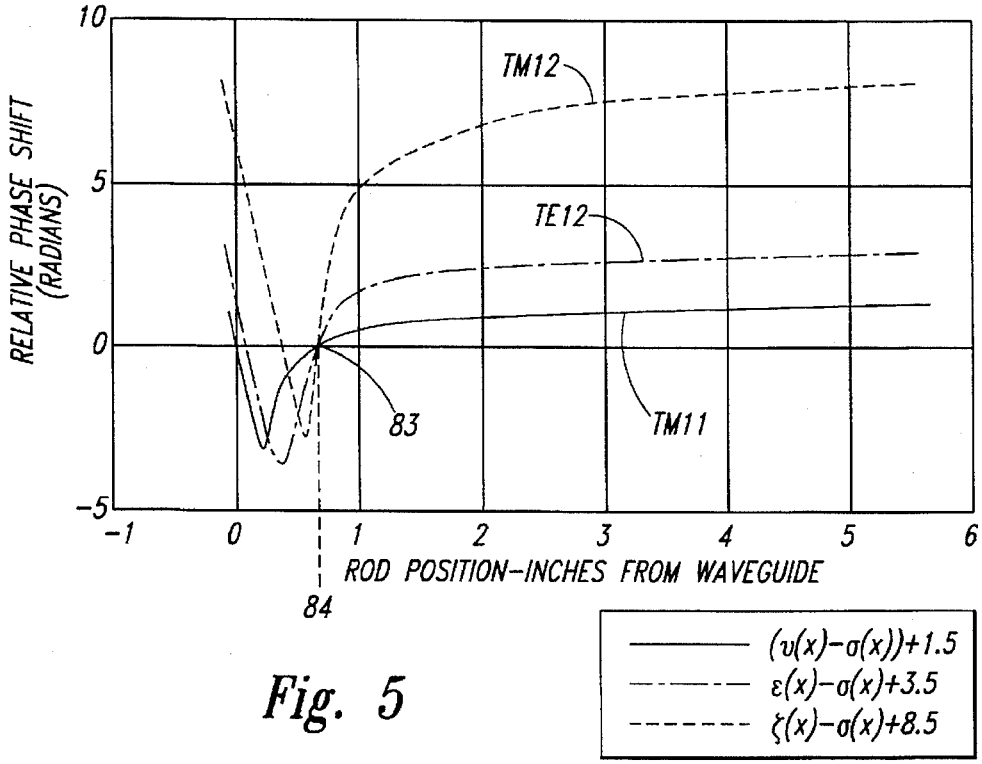
Fig. 5
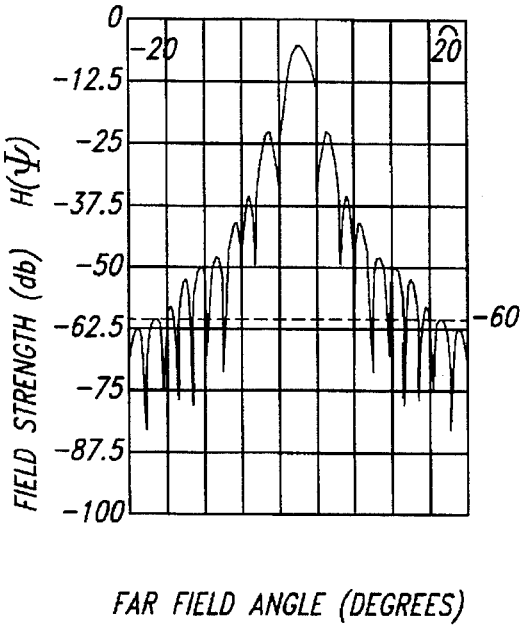
Fig. 6A−1
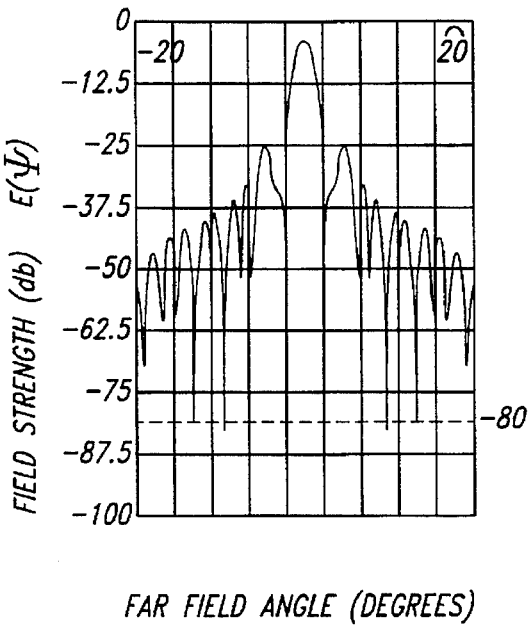
Fig. 6A−2

HIGH-GAIN, WAVEGUIDE-FED ANTENNA HAVING CONTROLLABLE HIGHER ORDER MODE PHASING

TECHNICAL FIELD

This invention relates to waveguide fed diverging shell antennas, and more particularly, to antennas employing positionable dielectric rods containing discontinuities to generate higher order modes and control phase relationships between the modes.

BACKGROUND OF THE INVENTION

Diverging shell antennas often employ waveguides to supply input signals. In such configurations, a dominant mode, such as a $TE_{11}$ mode in a circular waveguide, is used as the input signal. Such modes are generated in the waveguide from an external source in a manner known in the art.

In the absence of any other elements the $TE_{11}$ mode propagates from the waveguide through the diverging shell to the distal end of the diverging shell. The signal then exits through the antenna aperture and travels to the far field. Desired antenna performance characteristics such as gain, sidelobe levels, bandwidth, and E-plane and H-plane field strength distributions are often not achievable using this configuration. It is known that the performance or characteristics of an antenna can be adjusted by controlling a combination of modes at the distal end of the diverging shell. For example a high gain relatively narrow beam antenna pattern can be achieved by combining $HE_{11}$ with $TE_{12}$ and $TM_{12}$ modes.

It is therefore desirable to convert the dominant $TE_{11}$ mode supplied to the waveguide to a controlled combination of $HE_{11}$ and higher modes at the output aperature.

There are a number of methods of converting the dominant $TE_{11}$ mode supplied in the waveguide to a controlled set of modes in an output aperture. Where the dominant mode is a $TE_{11}$ mode in a circular waveguide, conversion of the $TE_{11}$ mode into an $HE_{11}$ mode within the waveguide is often employed as a first step.

This conversion can be achieved by a number of techniques such as using one of many forms of "reactive" surface for the outer wall of the circular waveguide. Typical "reactive" surfaces used for this purpose are metal corrugations, dielectric coated wire adjacent to an outer conducting surface, or a thin dielectric sleeve with an outer conducting surface. Another technique is the use of a dielectric rod positioned to be axially symmetrical with the waveguide. Where the cross-sectional geometry is chosen appropriately and a sufficient length is chosen, a conversion of the dominant $TE_{11}$ mode to the dominant $HE_{11}$ mode will occur, as is known in the art. In this manner, the dominant $HE_{11}$ hybrid mode is produced within the circular waveguide and feeds the diverging shell.

Where waveguide-fed diverging shells use an $HE_{11}$ mode as the input to the diverging shell, various techniques are employed to achieve a combination of known higher-order modes at the output aperture. For example, one prior art device utilizes a diverging shell having a multi-sectional construction. The shell diverges at an initial half-flare angle for a distance and then the half-flare angle approaches 0 degrees, forming a discontinuity in the wall of the diverging shell. Divergence resumes at a point further along the wall forming a second decontinuity. The flare angles and separation between discontinuities, or flare angle changes, are chosen to establish the desired relative phase and amplitude of the various modes such as to produce the desired radiation pattern characteristics. Because the shell wall discontinuities are fixedly incorporated in the diverging shell, tuning of the antenna by relocating the discontinuities is not achievable without completely restructuring the diverging shell.

In the prior art, the generation and relative phase relationships of the higher-order modes are determined by fixed elements or by elements not readily changeable. No adjustment of the relative modes for a given antenna configuration is contemplated. Further, none of the above utilizes a simply positioned, slideable element that can be slideably altered and adjusted to generate and control the phases of the various modes to achieve the desired antenna performance characteristics. As a result the performance or characteristics of an antenna cannot be adjusted after manufacture to optimize the antenna for the particular use nor can an antenna design be simply changed at low cost and experimentally verified for some new purpose prior to manufacture.

SUMMARY OF THE INVENTION

The inventive device comprises an antenna addressing the problems of the prior art by converting the dominant $TE_{11}$ mode in a circular waveguide to the dominant $HE_{11}$ hybrid mode within the waveguide through the use of a diameter discontinuity, e.g. a tapered portion in a dielectric rod and inputting the $HE_{11}$ mode to a diverging shell antenna. The device then controllably converts the $HE_{11}$ mode to higher order modes with predetermined phase relationships to the $HE_{11}$ mode. Conversion to these higher order modes is caused by discontinuities incorporated in the dielectric rod, such as a transition from a uniform diameter to a taper, and positioned within a region of the diverging shell that is of sufficient diameter to support only the first and second order modes. Because the discontinuities are positioned in a region of the diverging shell where modes higher than the second order cannot propagate, energy converted from the $HE_{11}$ mode is converted primarily to the $HE_{12}$, $TE_{l2}$ and $TM_{12}$ modes. The phase relationships between these modes at the output aperture can be optimized by adjusting the axial position of the dielectric rod.

Where desirable to enhance antenna performance, a third order set of modes in the inventive device is generated by a third order mode generator positioned with the diverging shell. The third order mode generator comprises a discontinuity located within the diverging shell in a region of sufficient diameter to support third order modes, but insufficient to support fourth order modes. This discontinuity converts some of the energy in the dominant $HE_{11}$ modes to $TE_{13}$ and $TM_{13}$ modes. In the preferred embodiment, the third order mode generator is an annular ring. The axial position of the dielectric ring can be selected to achieve the desired phase of the $TE_{13}$ and $TM_{13}$ modes at the output aperture.

In an alternate embodiment of the device a "reactive" surface is incorporated in an initial section of the diverging shell causing the $TE_{12}$ and $TM_{12}$ modes to propagate at the same phase velocity, thus forming an $HE_{12}$ mode structure which is maintained within that region of the shell. The "reactive" surface need not extend much beyond the regions of higher order mode forming discontinuities because as the shell diameter increases the propagation velocities of the $TE_{l2}$ and $TM_{12}$ as well as the $TE_{l3}$ and $TM_{13}$ modes approach free space velocity and act nearly as $HE_{12}$ and $HE_{13}$ hybrid modes even though a "reactive" surface is not present.

In the preferred embodiment of the device a dielectric lens is placed at the output aperture to convert the approximately spherical wave front generated by the dielectric rod and diverging shell into an approximately planar wave front. To limit diffraction effects (minimize far out sidelobes) from the aperture a lossy material preferably surrounds the edge of the aperture, thereby reducing diffraction currents.

BRIEF DESCRIPTION OF THE DRAWINGS

FIG. 5 is a graph showing the relative phase relations of the modal components in the preferred embodiment of FIG. 1.

FIGS. *6a–6e* are graphs illustrating the effect of adjusting relative phase of the modes.

DETAILED DESCRIPTION OF THE INVENTION

Figure 1:
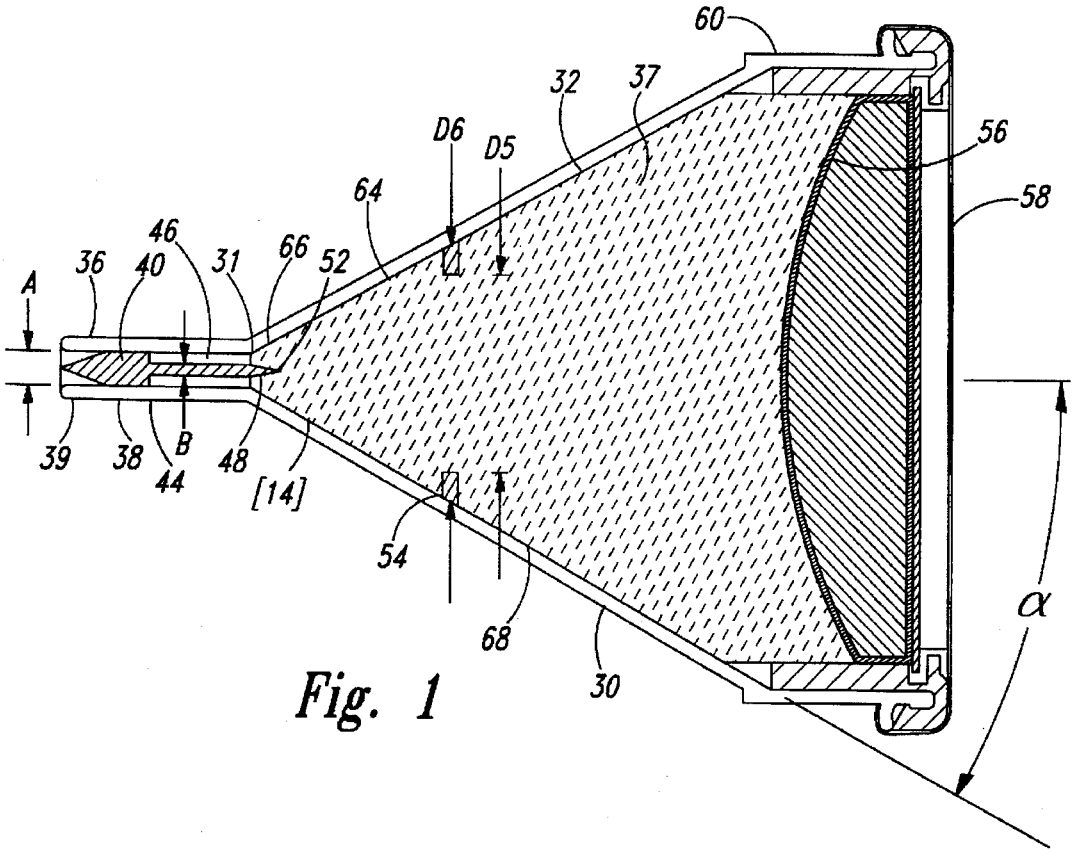
FIG. 1 is an axial cross-sectional view of the preferred embodiment of the inventive antenna.

As shown in FIG. 1, the preferred embodiment of the inventive antenna comprises a diverging shell 30 having a conducting inner surface 32 and a half-flare angle α. The diverging shell 30 is of circular cross-section, forming a tapered cone filled with a dielectric material 37. The diverging shell 30 is fed by a circular waveguide 36 through a port 31. It is preferred that the cross-section of the waveguide 36 be of the same geometric shape as the diverging shell 30. However, other waveguide and or diverging shell shapes such as those with rectangular or elliptical cross-sections may be employed.

Figure 2:
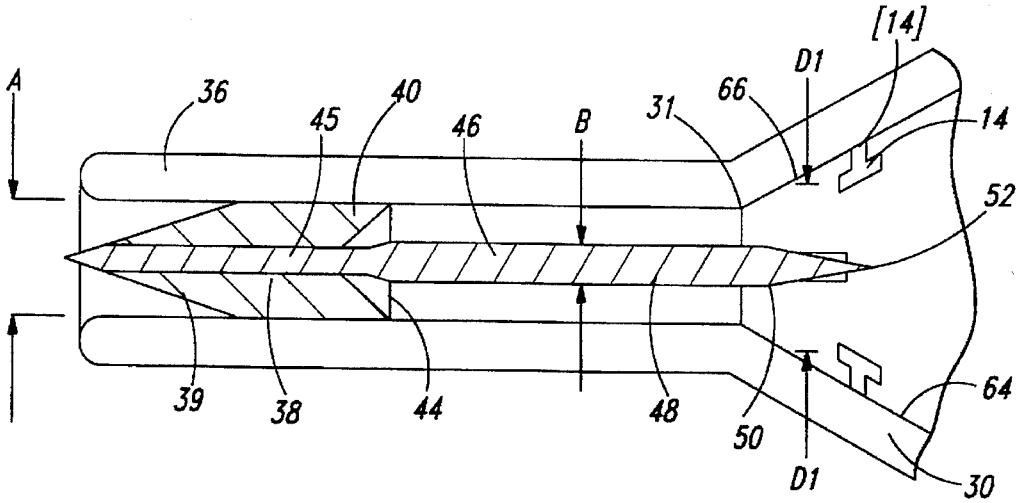
FIG. 2 is a detailed cross-sectional view of a portion of the antenna of FIG. 1.

FIG. 2 shows the intersection of the waveguide 36 and the diverging shell 30 in greater detail. A dielectric rod 38 is positioned within the waveguide 36 with a radially enlarged portion 40 of the dielectric rod 38 in radial engagement with the wall of the waveguide 36. A tapered input section 39 is formed at one end of the dielectric rod 38. The shape of the preferred embodiment is conical to improve impedance matching; however, other shapes may be utilized, such as a flat or a differently tapered input tapered section.

The end of the rod 38 opposite the input section 39 is tapered inwardly to form a diameter discontinuity at 44. The dielectric rod 38 has formed therein an axial bore which slideably receives a reduced diameter section 45 of a dielectric rod 46. The rod 46 tapers outwardly from the reduced diameter section 45 to an enlarged diameter section 48 that extends longitudinally from the taper 44 into the diverging shell 30. The end of the enlarged diameter section 48 tapers inwardly at 50 to form a first discontinuity 50. A second discontinuity 52 is formed at the distal end of the dielectric rod 46 by the convergence of the taper. It is understood that the tapered shape of the rod 46 with its two discontinuities 50, 52 is for the purpose of illustration and not for limitation. Other shapes, such as a step or and inverted taper, could be substituted for the discontinuities 50, 52 formed by the taper. Other shapes for the discontinuities 50, 52 could also be utilized. For example a flat end (which is not preferred due to reflections) or a rounded end or a channeled end could be used to provide a proper termination of the dielectric rod 46, depending on the antenna characteristics desired. The axial position of the dielectric rod 46 within the dielectric rod 38 may be adjusted to achieve an optimum or desired performance. However, it will be understood that the dielectric rod 46 may be integrally formed with the dielectric rod 38 in which case the dielectric rod 38 and the dielectric rod 46 are not axially movable with respect to each other.

Referring again to FIG. 1, a third order mode generator may be positioned in the diverging shell 30 with its location determined as described below to enhance antenna gain for some applications. It is understood that the use of such a mode generator is optional and is not for limitation. Past the third order mode generator 54, the diverging shell continues to expand along the half-flare angle α. A lens 56 of dielectric material is positioned at the output aperture 58. A diffraction current suppression ring of a lossy material preferably circumferentially surrounds the output aperture 58.

A $TM_{12}$ mode phase shifter 14 (see, also, FIG. 2) consisting of a dielectric washer with a tapered cross section to form an anisotropic dielectric section preferential to the $TM_{12}$ mode may be concentrically suspended with the respect to the antenna centerline near but distal from the discontinuity 52. When used, the phase shifter extends the range of relative phase control provided by positioning the dielectric rod 46. The length of the phase shifter 14 is chosen to provide an approximate value consistent for a particular set of antenna performance requirements. It is understood the use of such a phase shifter 14 is optional and not for limitation.

Figure 3:
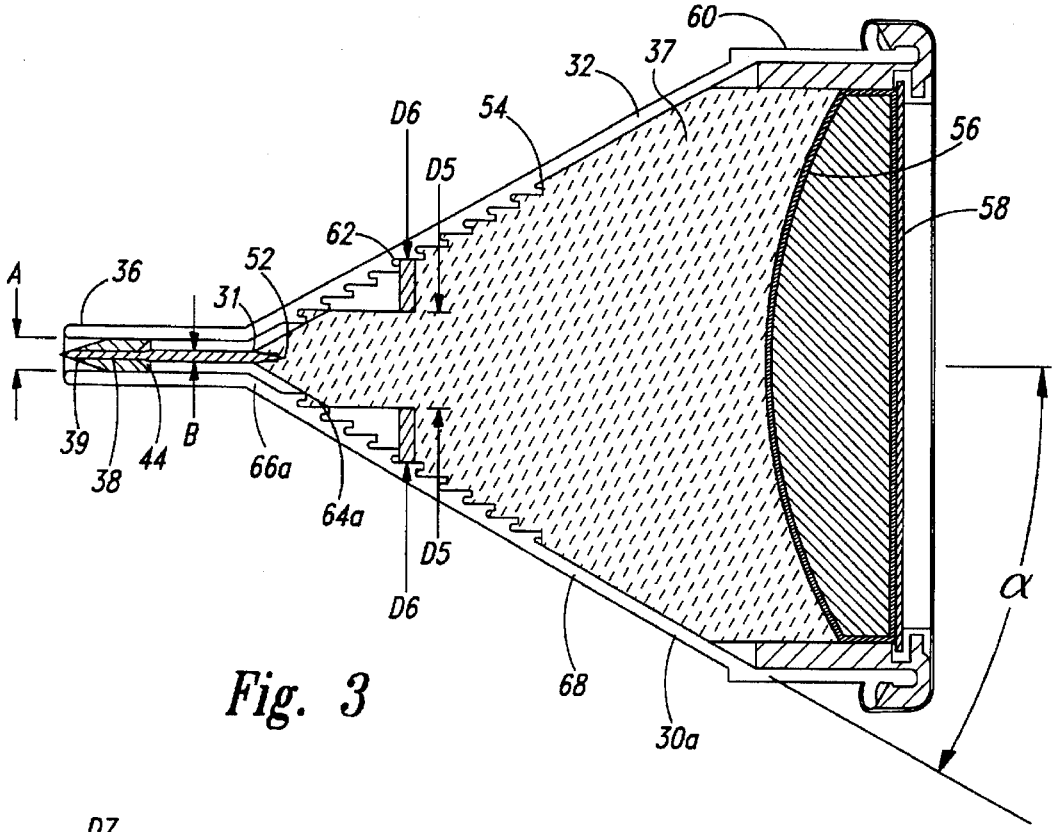
FIG. 3 is an axial cross-sectional view of an alternate embodiment of the inventive antenna.
Figure 4:
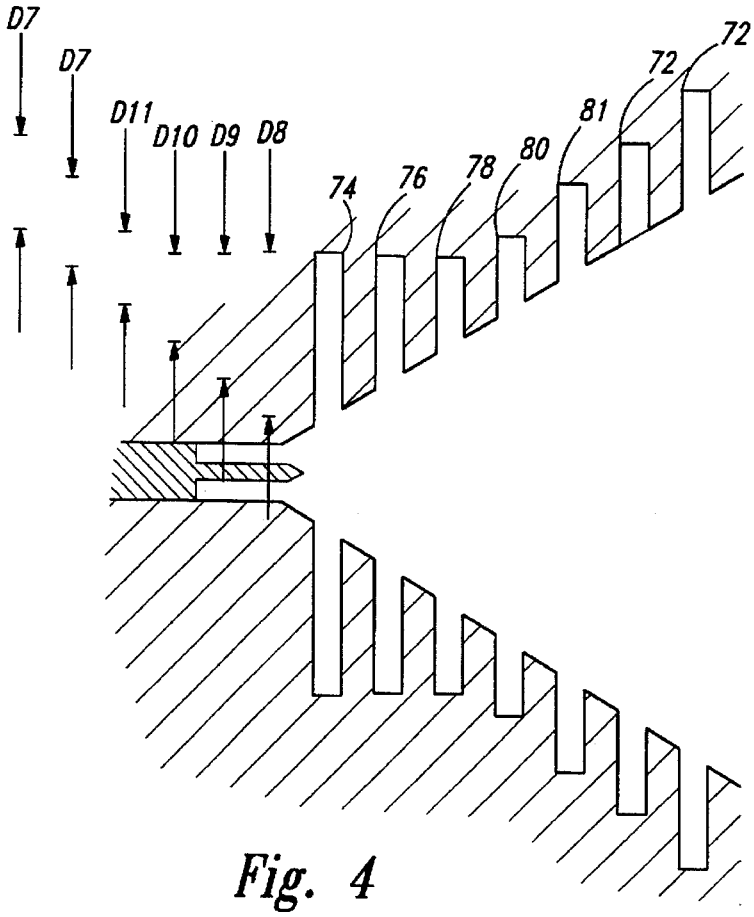
FIG. 4 is a detailed cross-sectional view of an alternative embodiment of the antenna illustrating a typical "reactive" surface.
Figures 1, 6B:
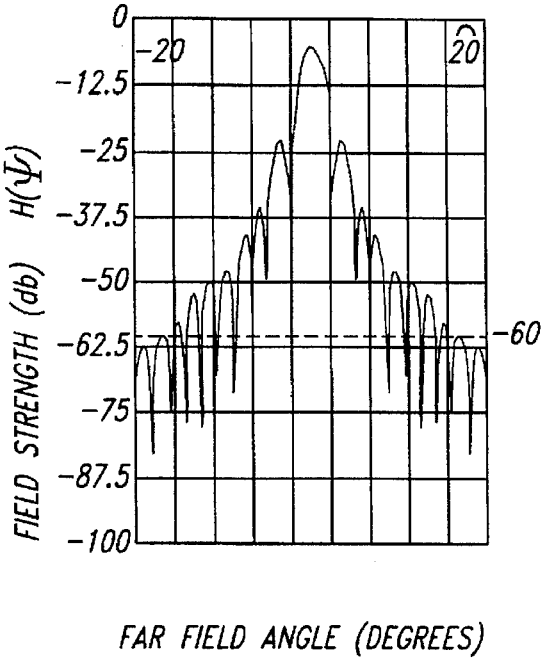
Figures 2, 6B:
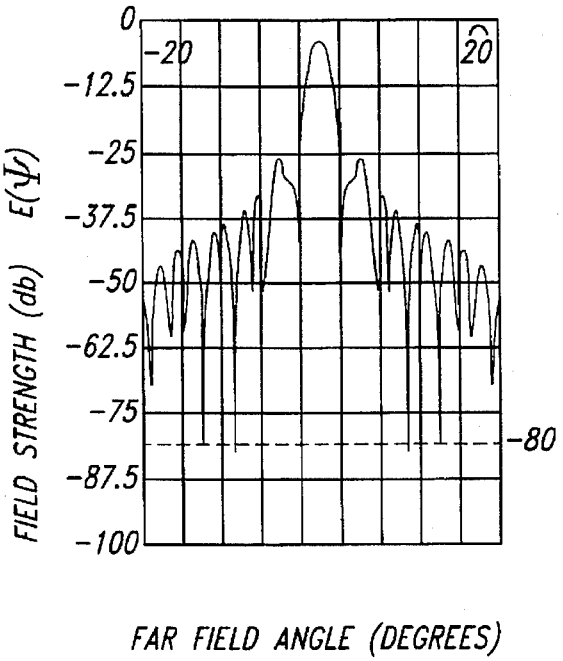
Figures 1, 6C:
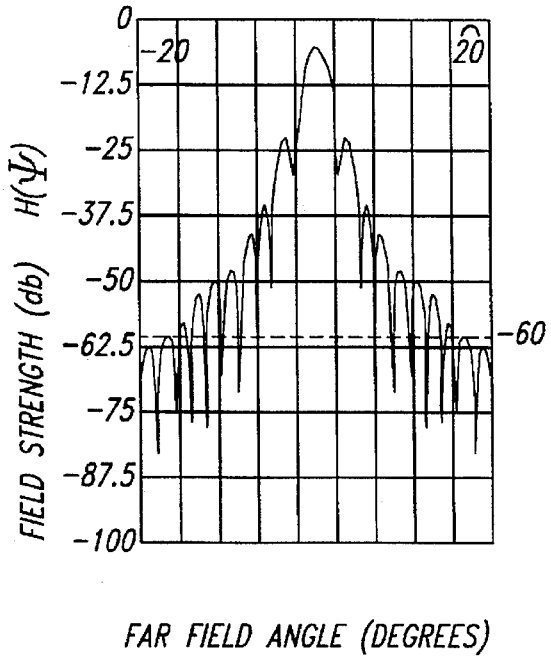
Figures 2, 6C:
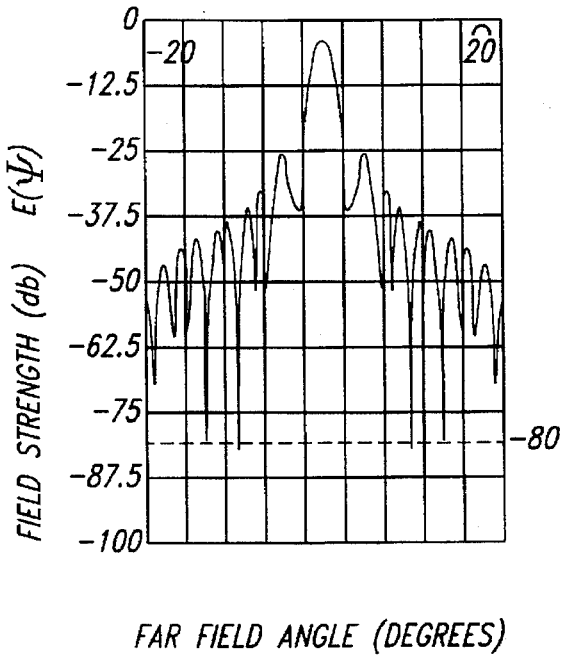
Figures 1, 6D:
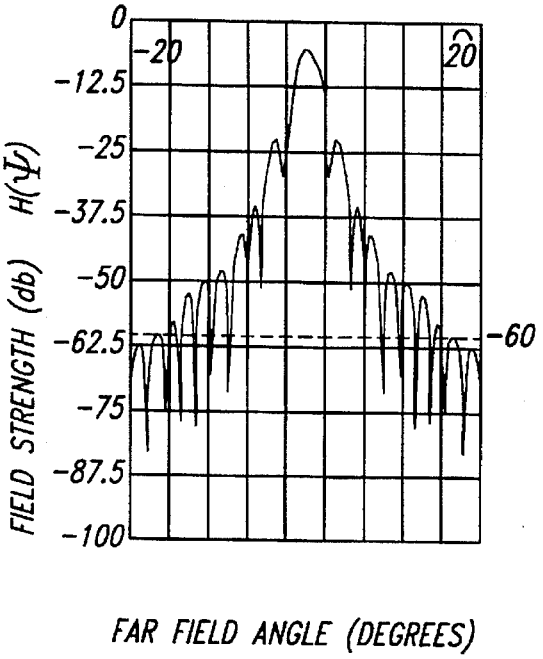
Figures 2, 6D:
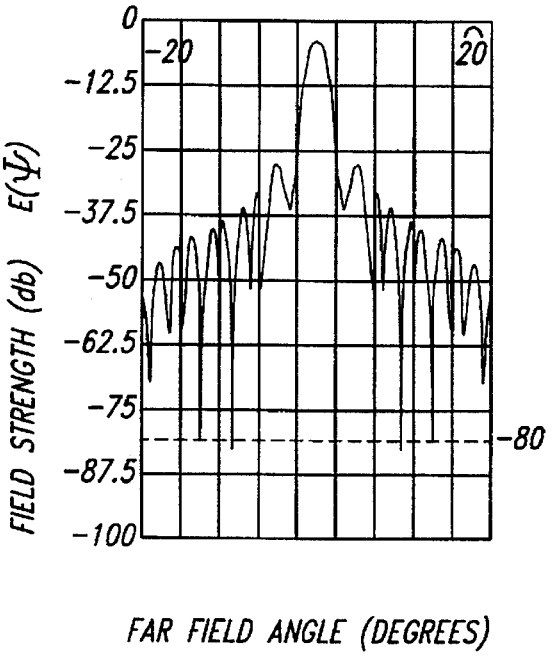
Figures 1, 6E:
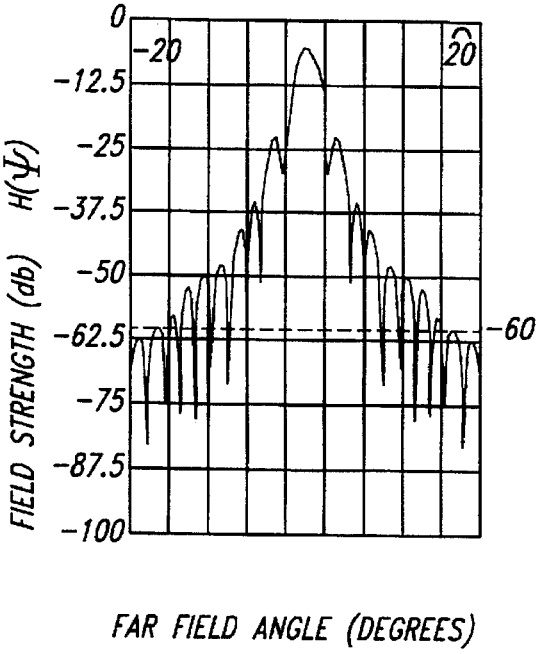
Figures 2, 6E:
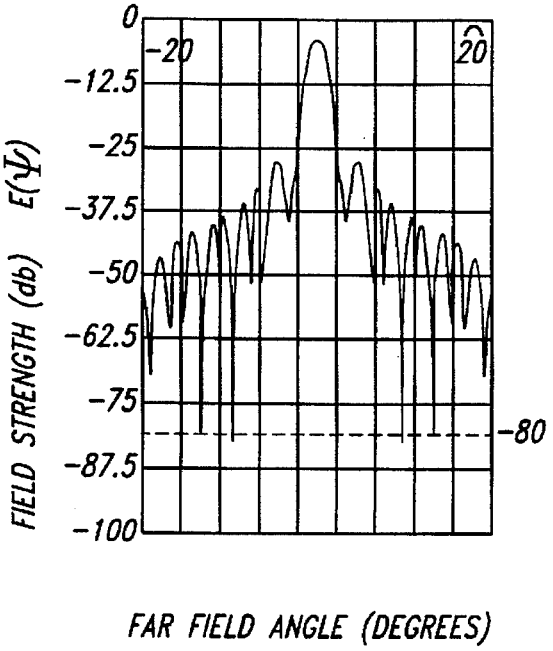

An alternate embodiment of the inventive device is shown in FIG. 3. The embodiment of FIG. 3 is identical to the embodiment of FIG. 1 except that the embodiment of FIG. 3 employs a "reactive" surface 62 in the initial region 64 of the diverging shell **30*a* and extends somewhat beyond the last mode generator employed. As explained below the "reactive" surface causes the $TE_{l2}$ and $TM_{12}$ to propagate through the dielectric material 37 at the same velocity, thus forming the $HE_{12}$ mode. In a similar manner the $TE_{l3}$ and $TM_{13}$ modes form the $HE_{13}$ mode. Hence the embodiment of FIG. 3 results in improved bandwidth relative to the embodiment of FIG. 1 since fewer modes need be aligned to achieve the desired antenna performance. FIG. 4 illustrates one of many preferred embodiments of the "reactive" surface for the embodiment of FIG. 3**.

The operation and design considerations of the inventive device will now be described with reference to FIGS. 1 and 2. In operation a $TE_{11}$ mode is generated within the waveguide 36 in a manner known to the art. The $TE_{11}$ mode propagates down the waveguide 36 to the tapered input section 39 where it enters the dielectric rod 38. The $TE_{11}$ mode passes through the tapered input section 39 and the large diameter 40 until it reaches the diameter discontinuity 44, at which point the $TE_{11}$ mode begins to transform to the $HE_{11}$ hybrid mode and continues into the smaller dielectric rod 46.

In the small diameter dielectric rod 46 the boundary conditions require that both E and H field components exist in the direction of propagation. This forces a gradual conversion of the $TE_{11}$ mode to the $HE_{11}$ mode as the wave propagates along the rod 46. The small diameter dielectric rod 46 is chosen to be of sufficient length such the $TE_{11}$ mode is converted substantially to the $HE_{11}$ mode. The minimum length for this transition is typically 4 to 6 wavelength. However, the exact length of the dielectric rod 46 is not critical to the overall operation. This method of producing $HE_{11}$ modes is well known in the art.

As mentioned above, the diameter discontinuity 44 aids in the conversion of the $HE_{11}$ mode due to its impedance transforming properties, but the conversion would occur in the absence of the taper (e.g., a step) if the small diameter dielectric rod 46 were sufficiently long. Other methods of impedance transformation may be used as well without limitation to the scope of the invention.

In order to suppress the generation of unwanted higher order modes during the conversion from the $TE_{11}$ to the $HE_{11}$ mode, the dielectric rod 46 must have a sufficiently small diameter B. The diameter is chosen in accordance with the known formula:

$$\frac{B}{\lambda o} < \frac{2.405}{\sqrt{\epsilon - 1}}$$

where λo is the free space wavelength and ε is the dielectric constant of the rod.

The $HE_{11}$ mode travels though the waveguide 36 into an initial region 66 of the diverging shell 30. There, the wave encounters the discontinuity 50 where a portion of the energy is converted to an $HE_{12}$ mode. The wave then encounters the discontinuity 52, where a further portion of its energy is converted to the $HE_{12}$ mode. To limit conversion of the $HE_{11}$ mode to only the $HE_{12}$ mode, the discontinuities 50, 52 are positioned such that the diameter of the diverging shell is sufficient to support the $HE_{12}$, but is less than the cutoff diameter for the third and higher order modes. Thus conversion to the $HE_{13}$ mode will be suppressed. In the preferred embodiment, the discontinuity 50 and the second discontinuity 52 are separated by approximately one-half wavelength such that $HE_{12}$ modes generated at each of the discontinuities 50, 52 combine additively.

In the preferred embodiment the enlarged diameter section 40 of the dielectric rod 46 has a linear taper forming the discontinuity 52 at an end opposite the reduced diameter section 45. Other end shapes may be chosen which would alter the relative magnitude and phase of the $HE_{11}$ and $HE_{12}$ modes to produce other desired antenna characteristics for specific applications.

After the wave passes the discontinuity 52, it passes into an intermediate region 64 to which the dielectric rod does not extend. In the immediate region 64, then the boundary conditions imposed by the dielectric rod 38 no longer exist. The hybrid modes will therefore degenerate into their TE and TM components which propagate at different phase velocities. Since at the point of the discontinuity 52 the diverging shell diameter is large compared to the cut-off diameter for the $HE_{11}$ mode, the $TE_{11}$ and $TM_{11}$ components of the $HE_{11}$ mode will both propagate at near free space velocity, hence the resulting field shape for these modes will approximate that of the $HE_{11}$ mode at the output aperture. In contrast the diameter of the diverging shell is much closer to the cut-off diameter for the $TE_{12}$ and $TM_{12}$ modes and hence will propagate at quite different velocities for distances near the discontinuity 52 resulting in significant phase differences between the $TE_{12}$ and $TM_{12}$ modes when reaching the output antenna aperture 58. This phase difference is altered as desired by repositioning the discontinuity 52 by adjusting the longitudinal position of the dielectric rod 46.

For designs where greater magnitude of phase shift is desired between the $TE_{12}$, $TM_{12}$, and the pseudo $HE_{11}$ mode, a $TM_{12}$ phase shifter 14 is installed within the diverging shell 30 just beyond the dielectric rod discontinuity 52. The $TM_{12}$ phase shifter consists of a hollow cone shaped dielectric suspended within the diverging shell just on the aperture side of the discontinuity 52. This shape of dielectric acts as an anisotropic dielectric which provides differential phase shift to the $TM_{12}$ mode relative to the other modes. The amount of phase shift provided is proportional to the length of the hollow dielectric cone. It is understood the use of the phase shifter 14 is optional for providing greater flexibility but the invention is not limited to its use.

In the alternate embodiment of FIG. 3 the "reactive" surface placed in the initial portion of the diverging shell **30*a* and extending a small distance beyond the last discontinuity employed, either 52 or 54**, provides the necessary boundary conditions to maintain all modes as hybrid modes. Since in this embodiment only one-half the number of modes need to be phase controlled, the bandwidth is increased with some increase in complexity.

One preferred configuration of the "reactive" surface consists radial corrugations along the conducting wall of the diverging shell **30*a* as shown in FIG. 4. In this preferred embodiment of the corrugated wall, the corrugations 72 are approximately λ/10 wide and have a depth D7 of λ/4 except the first corrugation 74 which as a depth D8 of λ/2 and a few transitional corrugations 76, 78, 80, 81 having depths D8, D9, D10, D11 respectively, progressing from λ/2 to λ/4. The transition corrugations 76, 78, 80, 81 present varying reactances to an input wave as it moves axially through the diverging shell 30*a*. The depth of the transitional corrugations 76, 78, 80, 81 are chosen such that reactance presented by them compensates for any reactive mismatch between the input waveguide 36 and the diverging shell 30*a*. The diverging shell thus presents a matched load to the signal from the input waveguide 36 through the diverging shell 30*a***, thereby improving efficiency and minimizing cross polarization.

Other forms of "reactive" walls will be obvious to those skilled in the art. One example consists of circumferential corrugations shown in concept in FIG. 3. Another example of such "reactive" wall includes a dielectric-coated helically-wrapped wire adjacent to the outer wall of the diverging shell **30*a*. Still another example comprises a slim conical sleeve of dielectric material directly adjacent to the smooth conducting inner surface 32 of the diverging shell 30*a***.

In either the preferred or the alternative embodiment, as the wave leaves the initial region 64, **64*a*, it enters into the larger region 68, 68*a*. in the larger region 68, 68*a*, the diameter of the diverging shell 30, 30*a*** is sufficiently large that the TE and TM components propagate with approximately the same velocity. This allows the HE mode structure to remain essentially intact.

The $HE_{11}$ and $HE_{12}$ modes encounter an optional third order mode generator within the diverging shell 30, **30*a*. Preferably, the third order mode generator 54 within the diverging shell 30, 30*a* is a dielectric ring or "washer" with an internal diameter D5 and a thickness t. The third order mode generator is located in the diverging shell 30, 30*a*** where the shell diameter D6 is large enough to propagate the $HE_{13}$ mode (alternate embodiment) or the $TE_{13}$ and $TM_{13}$ modes (preferred embodiment), but insufficient to permit propagation of the fourth and higher order modes.

The third order mode generator functions by presenting A discontinuity to the wave comprised of the $HE_{11}$ and $HE_{12}$ modes, thus converting a portion of the $HE_{11}$ mode to the third order mode. The amount of energy converted to the third order mode is controlled primarily by the aperture diameter of the washer D5. The thickness t is given by:

$$t=\frac{\lambda o}{2}*\sqrt{\epsilon-1}$$

where t is the thickness, λo is the free space wavelength and ϵ is the dielectric constant of the material of the third order mode generator 54. The relative phase of the third order modes are determined by the axial location of the mode generator within the diverging shell 30, 30*a*. It is understood that the use of the third order mode generator is optional consistent with specifically desired antenna performance characteristics and not as a limitation the inventive device.

In the preferred embodiment, the half-flare angle α is chosen to be approximately 30 degrees, although angles varying substantially from 30 degrees may be designed depending on the antenna application. In the preferred embodiment the half-flare angle α is chosen such as to permit a substantial range of adjustment of the axial position of the dielectric rod 46 and to minimize the length of the diverging shell for the desired diameter of the output aperture 58.

The preferred embodiment of the device contemplates the generation of only the first, second, and third order modes which have shown to provide adequate control over the output wave front electromagnetic characteristics. It is within the scope of the invention, however, to generate higher order modes to provide further control over the output electromagnetic radiation characteristics. The generation and control of higher order modes will be obvious to one skilled in the art.

For minimum cross-polarization and equal "E" and "H" plane beam widths the HE or pseudo HE modes should be balanced. That is $$-Z_0*\frac{2}{H_z}=1$$

where $Z_0$ is the characteristic impedance of free space and $E_z$ and $H_z$ are the longitudinal components of the hybrid modes. The balanced mode condition for the dielectric rod 46 requires the ratio of the small diameter B to the waveguide diameter A to be greater than 0.617. However, deviations from this condition results in only slight imbalance, with tolerable imbalances achievable with ratios as small as 0.4.

It is an advantage of the preferred embodiments of this device that the dielectric rod 46 is slideable within the waveguide 36. In operation this permits the location of the discontinuities 50, 52 to be adjusted relative to the output aperture by slideably adjusting the axial position of the rod 46, either by adjusting the axial position of the larger diameter dielectric rod 38 or by adjusting the axial position of the smaller diameter dielectric rod 46 with respect to the larger diameter dielectric rod 38. Because the relative phase of the $HE_{11}$ and higher order modes at the output of the aperture 58 are highly dependent upon the position of the discontinuities 50, 52 with respect to the output aperture 58, moving the dielectric rod 46 adjusts the relative phase of the $HE_{11}$ mode and the higher order modes at the output aperture. Thus, adjustment of the position of the dielectric rod 46 allows tuning of the relative phases at the output aperture.

As shown by FIG. 5, the relative phase relationships of the $TE_{12}$ and $TM_{12}$ components with respect to the $HE_{11}$ mode at the output are affected by the position of the of the dielectric rod discontinuities 50, 52. It has been determined that a zero phase shift difference may be achieved at the output aperture 58 as indicated by the crossover point 83. This occurs for the preferred embodiment operating at 38 GHz when the discontinuities are approximately ½ inch from the output of the waveguide 36 as indicated at point 84.

FIGS. 6*a*–6*e* show the affect of axially positioning the dielectric rod 46 upon radiation pattern characteristics for the preferred embodiment of FIG. 1.

We claim:

1. A waveguide fed antenna apparatus comprising:

a diverging conducting shell having a waveguide port communicating with one end of a waveguide, an aperture at a location axially spaced from the waveguide port, and a diverging portion between the waveguide port and the aperture;

a first dielectric material within the shell;

a dielectric rod of a second dielectric material having a diameter discontinuity for converting a $TE_{11}$ mode propagating through the dielectric rod to an $HE_{11}$ mode, the dielectric rod having a circular cross-section with a diameter $$B<\frac{2.405*\lambda_0}{\sqrt{(\epsilon-1)}}$$

where $\lambda_0$ is the freespace wavelength, and ϵ is the dielectric constant of the second dielectric material, the length of the dielectric rod downstream of the discontinuity being sufficient to produce substantial conversion of the $TE_{11}$ mode to the $HE_{11}$ mode;

a support structure supporting the dielectric rod so that it extends from the waveguide toward the aperture along the axis of the shell and a third order mode generator located within the diverging shell.

2. The apparatus of claim 1 wherein the third order mode generator is an annular dielectric ring axially located in the diverging shell at a location where the diverging shell has cross-sectional dimensions insufficient to support fourth order modes.

3. A waveguide fed antenna apparatus comprising:

a diverging conducting shell having a waveguide port communicating with one end of a waveguide, an aperture at a location axially spaced from the waveguide port, and a diverging portion between the waveguide port and the aperture;

a first dielectric material within the shell;

a dielectric rod of a second dielectric material supported in the waveguide so that it extends from the waveguide toward the aperture along the axis of the shell, the dielectric rod having a diameter discontinuity for converting a $TE_{11}$ mode propagating through the dielectric rod to an $HE_{11}$ mode, the cross-sectional dimensions of the dielectric rod from the diameter discontinuity toward the aperture of the shell being substantially constant and sufficiently small to prevent substantial development in the substantially constant diameter portion of the rod of modes converted from the $TE_{11}$ mode other than the $HE_{11}$ mode, the length of the dielectric rod downstream of the discontinuity being sufficient to produce substantial conversion of the $TE_{11}$ mode to the $HE_{11}$ mode; and a $TM_{12}$ phase shifter positioned in the diverging conductive shell.

4. An antenna apparatus comprising:

a conductive shell having a waveguide port and an aperture spaced apart from each other along an axis of the shell;

a mode converter receiving a $TE_{11}$ mode and converting the $TE_{11}$ mode to an $HE_{11}$ mode, the mode converter being a dielectric rod discontinuity;

a mode generator within the shell receiving the $HE_{11}$ mode, the mode generator generating from the $HE_{11}$ mode a mode of an order higher than the $HE_{11}$ mode, the axial position of the mode generator being adjustable so that the phase of the $HE_{11}$ mode and the phase of the higher order mode have a predetermined relationship to each other at the aperture of the shell; and a $TM_{12}$ phase shifter positioned in the conductive shell.

5. An antenna apparatus comprising:

a conductive shell having a waveguide port and an aperture spaced apart from each other along an axis of the shell;

a mode converter receiving a $TE_{11}$ mode and converting the $TE_{11}$ mode to an $HE_{11}$ mode, the mode generator being a dielectric discontinuity;

a mode generator within the shell receiving the $HE_{11}$ mode, the mode generator generating from the $HE_{11}$ mode a mode of an order higher than the $HE_{11}$ mode, the axial position of the mode generator being adjustable so that the phase of the $HE_{11}$ mode and the phase of the higher order mode have a predetermined relationship to each other at the aperture of the shell; and a second mode generator in the diverging shell, the second mode generator generating a third mode of higher order than the $HE_{11}$ mode and the higher order mode in response to the $HE_{11}$ mode.

6. A method of generating an electromagnetic output signal having predetermined electromagnetic characteristics at the aperture of a diverging shell comprising the steps of:

inputting to the diverging shell a fundamental mode;

axially positioning a movable discontinuity in the diverging shell to generate a second order mode which combines with the fundamental mode to produce the output signal;

measuring an electromagnetic characteristic of the electromagnetic output signal;

adjusting the axial position of the movable discontinuity to tune the phase of the fundamental mode at the aperture relative to the phase of the second order mode at the aperture; and generating a third order mode within the diverging shell, the third order mode having a predetermined phase relationship with respect to the fundamental mode.

* * * * *